United States Patent [19]

Eskeli

[11] 3,981,702

[45] Sept. 21, 1976

[54] HEAT EXCHANGER

[76] Inventor: Michael Eskeli, 7994-41 Locke Lee, Houston, Tex. 77042

[22] Filed: Dec. 2, 1974

[21] Appl. No.: 528,878

Related U.S. Application Data

[62] Division of Ser. No. 423,560, Dec. 10, 1973, abandoned, which is a division of Ser. No. 357,588, May 7, 1973, abandoned.

[52] U.S. Cl. ..... 62/87; 62/499; 165/2; 165/88; 415/1

[51] Int. Cl.[2] ..... F25B 3/00

[58] Field of Search ..... 62/499, 86, 87; 415/147, 1; 165/1, 2, 86, 88

*Primary Examiner*—Albert W. Davis, Jr.
*Assistant Examiner*—Sheldon Richter

[57] ABSTRACT

A method and apparatus for transferring heat from a first fluid which is normally gaseous to a second fluid which is normally a liquid, by using a rotating rotor with passages for said first fluid extending from rotor center outward and with passages for said second fluid also extending outward within said rotor with said two fluids being in heat exchange relationship within said rotor with heat another transferred from said first fluid to said second fluid, wherein said first fluid temperature is increased by compressing said first fluid within said rotor. Said two fluids are then returned in separate passages to the center of said rotor and discharged; said first fluid will leave said rotor colder than it entered and said second fluid will leave said rotor warmer than it entered. In one form of the invention, said rotor is mounted within a sealed casing with entry and exit for first fluid to said casing, and a heat exchanger for adding heat is provided. Also, in anothe form of the invention, nozzles are added to rotor walls for discharging said first fluid backward thus recovering some work. Also, a means is included for reducing external friction on rotor.

1 Claim, 7 Drawing Figures

HEAT EXCHANGER

CROSS REFERENCES TO RELATED APPLICATIONS

This application is a divisional patent application of "HEAT EXCHANGER", filed 12/10/73, Ser. No. 423,560 now abandoned. This patent application is also a divisional patent application of "Steam Generator", filed 5/7/73, Ser. No. 357,588 now abandoned.

This invention relates generally to means for compressing a gaseous first fluid with accompanying temperature increase and transferring heat from said gaseous first fluid to a second fluid during and after said compression, thus producing a heated second fluid and a cooled first fluid.

The art of heating and cooling has seen a variety of devices. In some of these devices, such as heat pumps, where a fluid is compressed in a compressor, then heat is removed in a heat exchanger after which the pressure is reduced, and then heat is added to the fluid, heating and cooling is produced by said two heat exchangers and work is supplied into said compressor. The main disadvantage is that these devices will require large amounts of power input to produce said heating and cooling.

Figure 2:
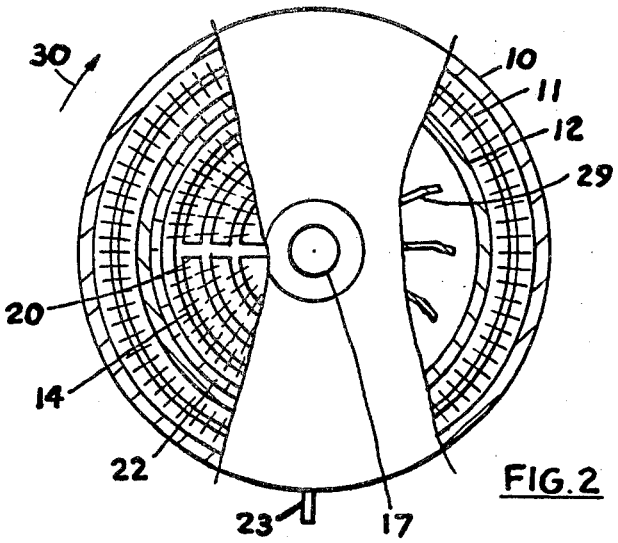
Figure 1:
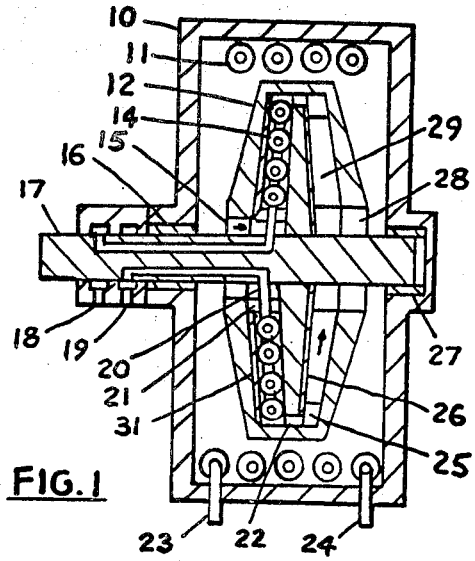

In FIG. 1, a cross section of one form of the heat exchanger is shown, and in FIG. 2, an end view of the unit shown in FIG. 1 is illustrated.

Figure 4:
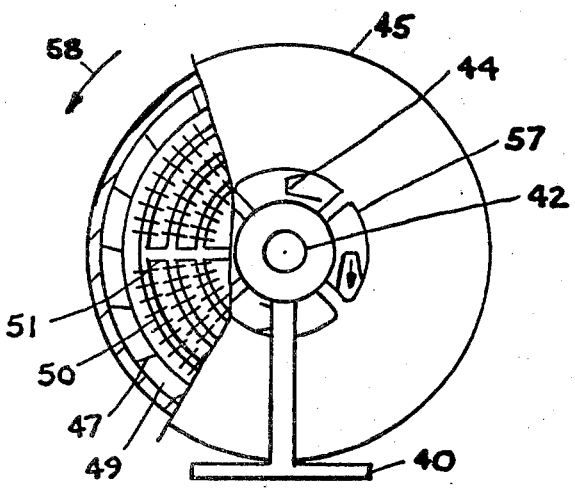
Figure 3:
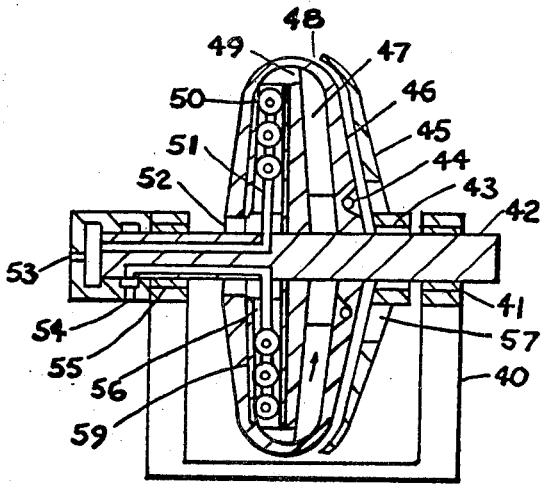

In FIG. 3, a cross section of another form of the heat exchanger is shown, and in FIG. 4 an end view of the unit shown in FIG. 3 is illustrated.

Figure 5:
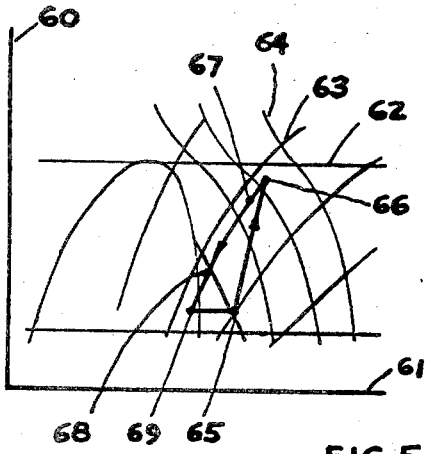

In FIG. 5, a typical pressure-enthalpy diagram for the first fluid used for the heat exchanger is shown with a work cycle illustrated thereon.

Figure 6:
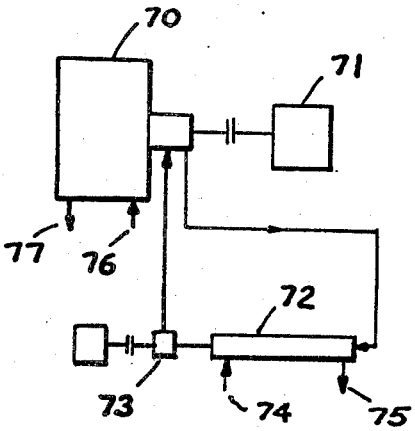

In FIG. 6, a typical schematic diagram for the application of the heat exchanger is shown.

Figure 7:
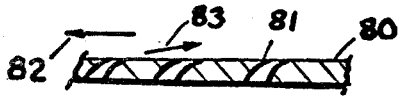

In FIG. 7, a detail of nozzles is illustrated.

It is an object of this invention to provide a means for producing heating by employing low temperature heat sources, and doing it in compact and relatively low cost device. Also, it is an object of this invention to provide a heat exchanger wherein the work input is low thus providing an economical means for producing said heating. Further, it is an object of this invention to provide a means for producing cooling.

Referring to FIG. 1, therein is shown a cross section of one form of the heat exchanger. 10 is casing, 11 is stationary heat exchanger for adding heat to said first fluid, 12 is rotor, 14 is rotor heat exchanger for said second fluid, 15 is first fluid entry to said rotor, 16 is shaft bearing and seal, 17 is rotor shaft, 18 and 19 are second fluid entry and exit to said rotor, 20 is second fluid distribution conduit, 21 is vane, 22 is first fluid nozzles, 23 and 24 are heating fluid entry and exit, 25 is first fluid space, 26 is thermal insulation, 31 is thermal insulation layer, 27 are bearings, 28 is rotor first fluid exit, 29 is vane on rotor exit side.

In FIG. 2, an end view with portions removed, is shown of the unit illustrated in FIG. 1. 10 is casing, 11 is heat exchanger, 12 is rotor, 29 are vanes on exit side of rotor, 17 is rotor shaft, 23 is heating fluid conduit, 22 are rotor first fluid internal nozzles, 14 is heat exchanger, 20 is second fluid conduit, and 30 indicates direction of rotation for rotor.

In FIG. 3, another form of the heat exchanger is shown in cross section. 40 is support base, 41 is shaft bearing, 42 is rotor shaft, 43 is friction reducer bearing, 57 is friction reducer opening to allow discharge of first fluid, 44 is first fluid discharge nozzle from rotor, 45 is friction reducer disc, 46 is rotor, 47 is rotor vane on rotor discharge side, 48 indicates space between rotor and friction reducer disc, 49 is first fluid passage at rotor periphery, 50 is rotor heat exchanger, 51 is second fluid conduit, 52 is first fluid inlet to rotor, 53 is second fluid inlet to rotor shaft passage, 54 is second fluid discharge, 55 is shaft bearing, 56 is vane, 59 is thermal insulation layer.

In FIG. 4, an end view of the unit shown in FIG. 3 is shown, with portions removed to illustrate interior details. 45 is friction reducer disc, 44 are first fluid exit nozzles, 57 are openings in friction reducer disc to allow first fluid discharge from rotor, 42 is rotor shaft, 40 is base, 49 is fluid passage with vanes 47, 50 is rotor heat exchanger for transferring heat from first fluid to second fluid, 51 are second fluid conduits, and 58 indicates direction of rotation for rotor.

In FIG. 5, a pressure-enthalpy diagram for a typical first fluid is shown. 60 is pressure line and 61 is enthalpy line, 62 are constant pressure lines, 63 are constant entropy lines and 64 are constant temperature lines. For the unit of FIG. 1, the cycle within rotor with external heat addition is 65 to 66 compression with cooling, 66 to 67 expansion which is isentropic, in nozzles 22 at rotor periphery, and 67 to 69 expansion in rotor vanes, with heat addition from 69 to 65. For the unit shown in FIG. 3, the compression is from 65 to 66, expansion in rotor exit side vanes from 66 to 68, and expansion in rotor exit nozzles from 68 to 69. If the rotor of FIG. 3 was within a closed casing, then heat addition would be from 69 to 65, same as for the unit of FIG. 1.

In FIG. 6, a typical schematic diagram is shown to indicate typical application of said heat exchanger. 70 is heat exchanger connected to drive means 71 via a power transmission shaft, 72 is a heat exchanger to remove heat from said second fluid which is circulated via conduits from said heat exchanger, 73 is circulation pump for said second fluid, 74 is a supply of cool fluid to heat exchanger 72 and 75 is discharge of hot fluid from heat exchanger 72, 76 and 77 are heating fluid entry and exit to said heat exchanger 70 stationary heat exchanger.

In operation, power is supplied to said heat exchanger rotor shaft from an external power source, causing it to rotate. First fluid enters said rotor via entry at rotor center and is compressed by centrifugal action on said first fluid by said rotor with accompanying temperature increase. The second fluid is circulated within said rotor in separate fluid passages in heat exchange relationship with said first fluid and heat is transferred from said hot first fluid to colder second fluid. The said first fluid is then passed to inward extending exit passageways near the periphery of said rotor, and discharged from said rotor near the rotor center. The second fluid is also passed along its own passageways to exit passages located within said rotor shaft and from there to exit. The compression of said first fluid is with cooling for best efficiency, with heat being transferred during compression from first fluid to second fluid, and heat may also be transferred after compression from said first fluid to said second fluid. The expansion in the exit side vanes is normally isentropic except for heat gains from rotor walls. The first fluid passageways for the rotor area for compression, is usually thermally insulated to prevent heat loss to rotor walls and to surrounding space, and also to prevent overheating said rotor structure which could lead to rotor failure.

There are two methods shown in the drawings to reduce work input to rotor, while still assuring the propelling of said first fluid through said rotor. In FIG. 1, there are shown nozzles at rotor periphery, item 22, and these nozzles are arranged to pass said first fluid backward in direction away from direction of rotation so that the first fluid absolute velocity will be less than the tangential velocity of said rotor in the area of said nozzles; this velocity reduction will provide for a suitable pressure differential to assure that said first fluid will be transported through said rotor. Said fluid will be discharged from nozzles 22 to space 25 for velocity adjustment before entry of said first fluid to exit side inward extending passageways formed by vanes 29. It should be noted that the actual exit velocity for said first fluid relative to said nozzles 22, is small, often in the area of 50–100 feet/second for most gases, and said nozzles are usually of the converging type. However, said nozzles 22 are sized and shaped to provide for maximum exit velocity for the pressure differential existing between entry and exit of said nozzles.

The second method for assuring that said first fluid will be transported through said rotor is shown in FIG. 3, where exit nozzles are provided for the first fluid leaving said rotor. Usually said exit nozzles 44 are located at a distance from rotor center that is greater than the radius of entry opening to said rotor for said fluid; this provides for needed pressure differential to assure that said first fluid passes through said rotor, while simultaneously producing thrust on said rotor wheel to reduce the work input to said rotor wheel from external sources. Said nozzles 44 are oriented to discharge said first fluid tangentially backward away from the direction of rotation, thus producing thrust. The velocities for the first fluid leaving said exit nozzles 44 are usually higher than those for nozzles 22, and nozzles 44 are sized and shaped to obtain highest attainable exit velocity for said first fluid leaving said rotor nozzles, for the pressure difference available.

It should be noted that the cooling of said first fluid during compression, as shown in FIG. 5, increases the first fluid pressure gain for the entry side of said rotor, and thus reduces the requirement for the need for other means to assure passage of said first fluid through said rotor. By cooling during compression said first fluid, and by using the other described means to reduce work input to said rotor, very low work input values to said rotor can be realised, thus providing for a very economical heat and cooling generating source.

The friction reducing disc shown in FIG. 3, item 45, is intented to reduce friction losses on rotor external surfaces especially in the areas where rotor surface speeds are high. This is done by allowing said disc 45 to rotate at its own speed; this speed can be regulated approximately to a correct value by setting the space between said rotor wall and said disc so that by gas friction said disc will rotate at approximately one half the speed of said rotor. This speed for said disc will reduce, theoretically, the rotor friction loss by approximately 40%, from the value without said disc. This is due to the lower velocity differential between rotor surface and surrounding fluid, and similarly between said disc and surrounding fluid. In FIG. 3, one such friction reducer is shown, mounted on one side of said rotor; said discs may be mounted on both sides of said rotor, and similarly also for the rotor of FIG. 1. By this means, the friction losses can be reduced for the rotors by nearly half, thus improving the overall performance of the heat exchanger. Alternately, said friction reducer discs may be omitted, and it should be noted that for lower rotor speeds, said discs are not of a great value.

In FIG. 7, a detail of nozzles 22 is shown. 80 is rotor center wall, 81 is a nozzle, 82 indicates direction of rotation of rotor and 83 indicates fluid leaving said nozzles 81. It should be noted that the fins of heat exchanger coils 14 could be slanted backward to also add to the pressure differential to transport said first fluid through rotor; this is also illustrated in FIG. 2; with said slanting of said fins which act as vanes, said nozzles 22 could be deleted, or the two methods used in combination as shown in FIG. 2.

The heat exchanger of this invention can be used to provide heating for various applications. For lower temperature needs, air can be used as the first fluid; for high temperature requirements, fluids with lower specific heats are needed. Also, for least work input to said rotor, the fluid should have properties wherein the work input between rotor entry and periphery, and the work output between rotor periphery and exit are nearly the same, while at the same time having a low specific heat at constant pressure.

The heat exchanger of this invention can be also used to generate steam. Normally, the second fluid is maintained in its liquid state at all points by pressurizing the said fluid, and the hot second fluid is then used to generate said steam in heat exchanger 72 of FIG. 6. The heat exchanger of this invention is intented for high rotational speeds with heavy material sections especially at rotor walls near rotor center; said high speeds are required normally for steam generation.

Various governors, controls and the like are used with the device; they are not a part of this invention and are not described.

The heat exchangers within the rotors are shown to be constructed from finned tubing, attached to rotor walls for support. Other types of heat exchangers may be used to obtain the same function of transferring heat from the hot first fluid to said second fluid. Normally, the heat exchangers are arranged for parallel flow, with both the said first fluid and said second fluid progressing otward from center together, in their separate passageways and in heat exchange relationship with each other, and then said second fluid is returned back to rotor center and passed along shaft passages to discharge. For maximum heat output especially at high second fluid exit temperatures, said parallel flow for said fluids is mandatory. It should be noted, that leaving temperatures for said second fluid may be in the range of 300° to 1000°F, depending of the rotor speed and the first fluid used.

The work input to rotor shaft is low. The second fluid enters and leaves the rotor near rotor center, and thus the work input for said second fluid is nearly zero, within the rotor. The first fluid is circulated by either having a pressure differential generated at nozzles near rotor periphery, or circulation is assured by discharging said first fluid from nozzles located further away from rotor center than the furthest distance from rotor center to entry openings; this could be compared to a siphoning effect. Work is required to accelerate the first fluid when such first fluid is passing outward within said rotor, and work is received by said rotor when said first fluid is decelerated during passage inward toward rotor center. The first fluid is forced to travel near the speed of the rotor by having vanes or other obstructions such as heat exchanger fins, within said inward and outward first fluid passages. Thus, the work input at the rotor shaft is the difference between the work of acceleration required on the compression side of said rotor, and the work of deceleration recovered on the expansion side of the rotor; also, some work is received by the rotor in the said peripheral nozzles 22, or in discharge nozzles 44.

I claim:

1. A method of transferring heat from a lower temperature to a higher temperature comprising compressing a first fluid by a centrifugal force within an outwardly extending first passage of a rotating rotor with accompanying temperature increase; expanding said compressible first fluid inwardly in a second passage that is connected at its outward end with said outwardly extending passage outer end by a first passage means, connecting said second passage inward end with a discharge means a second radial distance away from the center of rotation of said rotor, connecting said first passage inward end with an entry means with said entry means furthest radial distance from the center of rotation of said rotor being less than said second radial distance to provide a pressure differential for said first fluid within said rotor, said discharge means being a set of nozzles adapted of passing said first fluid and being oriented to discharge said first fluid away from the direction of rotation to generate torque on said rotor to assist in the rotation of said rotor, removing heat from said first fluid during and after compression within said rotor in a heat exchanger carried by said rotor.

* * * * *